US011420442B2

(12) United States Patent
Moriwaki

(10) Patent No.: US 11,420,442 B2
(45) Date of Patent: Aug. 23, 2022

(54) LIQUID DISCHARGE APPARATUS

(71) Applicant: Ricoh Company, Ltd., Tokyo (JP)

(72) Inventor: Yuta Moriwaki, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 40 days.

(21) Appl. No.: 17/169,739

(22) Filed: Feb. 8, 2021

(65) Prior Publication Data

US 2021/0252866 A1 Aug. 19, 2021

(30) Foreign Application Priority Data

Feb. 14, 2020 (JP) ..... JP2020-023403
Sep. 14, 2020 (JP) ..... JP2020-154183

(51) Int. Cl.
*B41J 2/175* (2006.01)
*B41J 2/165* (2006.01)

(52) U.S. Cl.
CPC ..... *B41J 2/16552* (2013.01); *B41J 2/17566* (2013.01); *B41J 2002/16558* (2013.01)

(58) Field of Classification Search
CPC .. B41J 2/16552; B41J 2/1714; B41J 2/16517; B41J 2/1721; B41J 2/17566
See application file for complete search history.

(56) References Cited

U.S. PATENT DOCUMENTS 10,155,388 B2 * 12/2018 Imahashi ..... B41J 2/16523
2013/0194346 A1 8/2013 Moriwaki
2014/0009531 A1 1/2014 Kaneko et al.
2014/0063121 A1 3/2014 Moriwaki et al.
2014/0152745 A1 6/2014 Park
2014/0265106 A1 9/2014 Saitoh et al.
2015/0077478 A1 3/2015 Kawabata et al.
2015/0085014 A1 * 3/2015 Ishida ..... B41J 2/1714 347/34
2015/0165770 A1 * 6/2015 Miyakoshi ..... B41J 2/1714 347/34
2016/0129693 A1 5/2016 Moriwaki et al.
2017/0106655 A1 4/2017 Moriwaki et al.
2018/0147854 A1 5/2018 Yoshida et al.
2018/0339519 A1 11/2018 Katoh et al.
2018/0370245 A1 12/2018 Moriwaki
2019/0232676 A1 8/2019 Kubodera et al.

FOREIGN PATENT DOCUMENTS

JP 2008-012880 1/2008
JP 2012-183756 9/2012
JP 2015-131419 7/2015

* cited by examiner

*Primary Examiner* — Jason S Uhlenhake
(74) *Attorney, Agent, or Firm* — Xsensus LLP

(57) ABSTRACT

A liquid discharge apparatus includes a liquid discharge device configured to discharge a liquid onto a discharge target from nozzles on a discharge surface of the liquid discharge device in a liquid discharge direction, an adhesion part including an adhesion surface to which mist of the liquid discharged by the liquid discharge device adheres, and a detector including a detection surface facing the adhesion surface of the adhesion part, the detector configured to detect a surface state of the adhesion surface of the adhesion part. The detection surface of the detector is above the discharge surface of the liquid discharge device in the liquid discharge direction, and the adhesion part is configured to move to change the adhesion surface facing the detection surface of the detector.

19 Claims, 12 Drawing Sheets

FIG. 5

| | A SURFACE | B SURFACE | C SURFACE | D SURFACE |
|---|---|---|---|---|
| T1,T5 | MIST ADHESION POSITION FACING SHEET | WAITING POSITION | CLEANING POSITION | DETECTION POSITION |
| T2,T6 | DETECTION POSITION | MIST ADHESION POSITION FACING SHEET | WAITING POSITION | CLEANING POSITION |
| T3,T7 | CLEANING POSITION | DETECTION POSITION | MIST ADHESION POSITION FACING SHEET | WAITING POSITION |
| T4 | WAITING POSITION | CLEANING POSITION | DETECTION POSITION | MIST ADHESION POSITION FACING SHEET |
| T0(T01,T02) | SEQUENTIALLY MAINTENANCE SURFACES IN ORDER FROM SURFACE TO WHICH MIST ADHERES FIRST | | | |

LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2020-023403, filed on Feb. 14, 2020, in the Japan Patent Office and Japanese Patent Application No. 2020-154183, filed on Sep. 14, 2020, in the Japan Patent Office, the entire disclosures of which are hereby incorporated by reference herein.

BACKGROUND

Technical Field

Aspect of this disclosure relates to a liquid discharge apparatus.

Related Art

An apparatus using a head to discharge a liquid includes a maintenance unit (head maintenance device) including a wiper to wipe a discharge surface (nozzle surface) of the head, for example. The head is also referred to as a liquid discharge head. The maintenance unit (head maintenance device) maintain a state of the head and recover the discharge ability of the head (head maintenance).

The maintenance unit includes a discharge surface cleaner, a discharge surface imaging device, a dirt recognition device, and a cleaner controller. The surface cleaner cleans a liquid discharge surface of the head. The discharge surface imaging device images the liquid discharge surface of the head. The dirt recognition device recognizes a dirt adhered on the liquid discharge surface of the head based on image information of the image imaged by the discharge surface imaging device and outputs discharge surface dirt information. The cleaner controller controls the discharge surface cleaner based on the discharge surface dirt information output by the dirt recognition device.

SUMMARY

In an aspect of this disclosure, a liquid discharge apparatus includes a liquid discharge device configured to discharge a liquid onto a discharge target from nozzles on a discharge surface of the liquid discharge device in a liquid discharge direction, an adhesion part including an adhesion surface to which mist of the liquid discharged by the liquid discharge device adheres, and a detector including a detection surface facing the adhesion surface of the adhesion part, the detector configured to detect a surface state of the adhesion surface of the adhesion part. The detection surface of the detector is above the discharge surface of the liquid discharge device in the liquid discharge direction, and the adhesion part is configured to move to change the adhesion surface facing the detection surface of the detector.

In another aspect of this disclosure, a liquid discharge apparatus includes a liquid discharge device configured to discharge a liquid onto a discharge target from nozzles on a discharge surface of the liquid discharge device in a liquid discharge direction, an adhesion part configured to be rotatably movable and including an adhesion surface configured to adhere mist of the liquid discharged by the liquid discharge device, and a detector including a detection surface facing the adhesion surface of the adhesion part, the detector configured to detect a surface state of the adhesion surface of the adhesion part. The discharge surface of the liquid discharge device, the adhesion surface of the adhesion part, and the detection surface of the detector are arranged on a same side with respect to the discharge target.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein:

FIG. 5 is a table illustrating timing of the maintenance operation of the maintenance control according to the first embodiment of the present disclosure;

Figure 1:
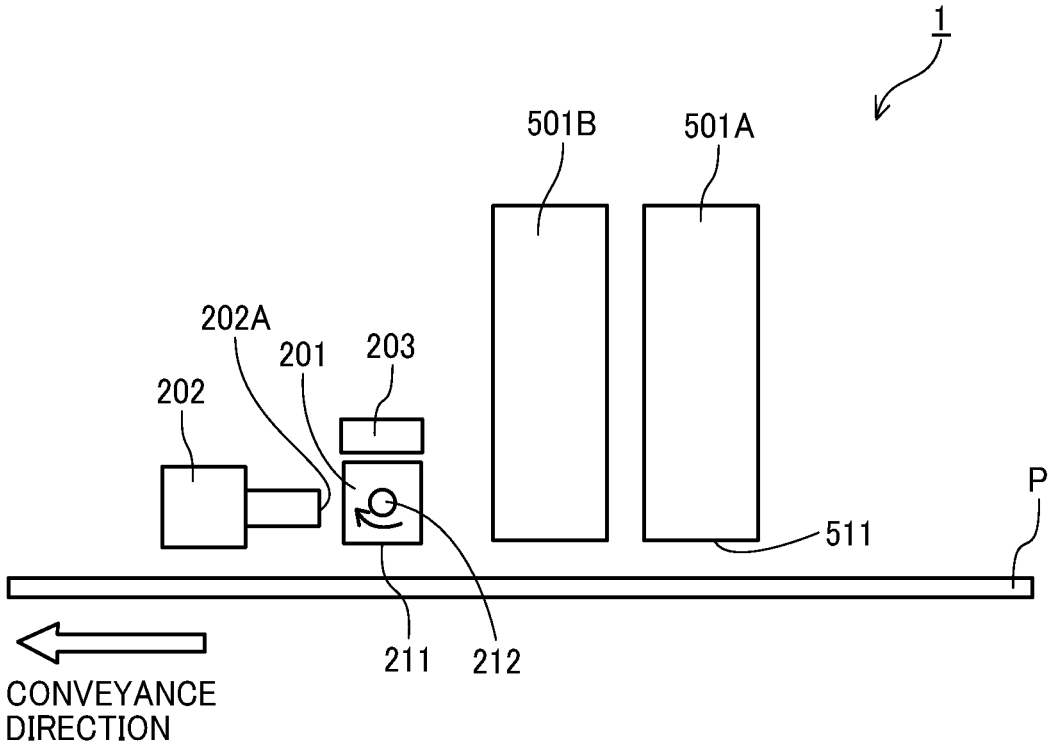
FIG. 1 is a schematic front view of a liquid discharge apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Referring now to the drawings, wherein like reference numerals designate identical or corresponding parts throughout the several views, embodiments of the present disclosure are described below. A liquid discharge apparatus 1 according to a first embodiment of the present disclosure is described below with reference to FIG. 1 and FIGS. 2A to 2D.

FIG. 1 is a schematic front view of the liquid discharge apparatus 1 according to the first embodiment of the present disclosure.

FIGS. 2A to 2D are partial front views of liquid discharge apparatus 1 illustrating a rotation position of an adhesion part 201.

Figure 3:
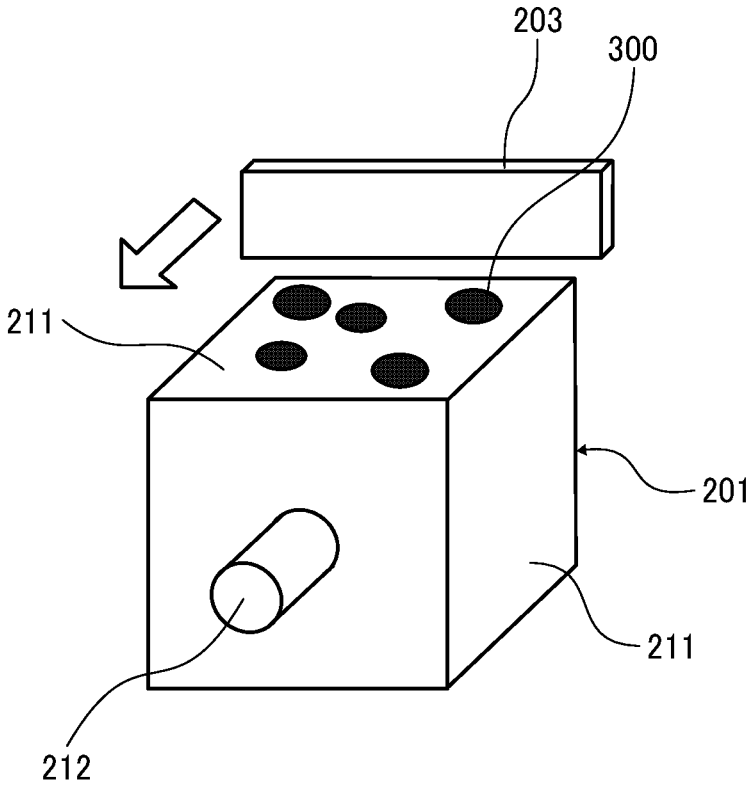
FIG. 3 is a perspective view of the adhesion part and a cleaner according to the first embodiment.

FIG. 3 is a perspective view of the adhesion part 201 and a cleaner 203 according to the first embodiment.

The liquid discharge apparatus 1 includes head arrays 501A and 501B serving as a liquid discharge device to discharge a liquid onto a sheet P as an application target such as a continuous sheet, for example. An operation of discharging the liquid onto the sheet P from the head arrays 501A and 501B is also referred to as a "liquid discharge operation."

Figure 14:
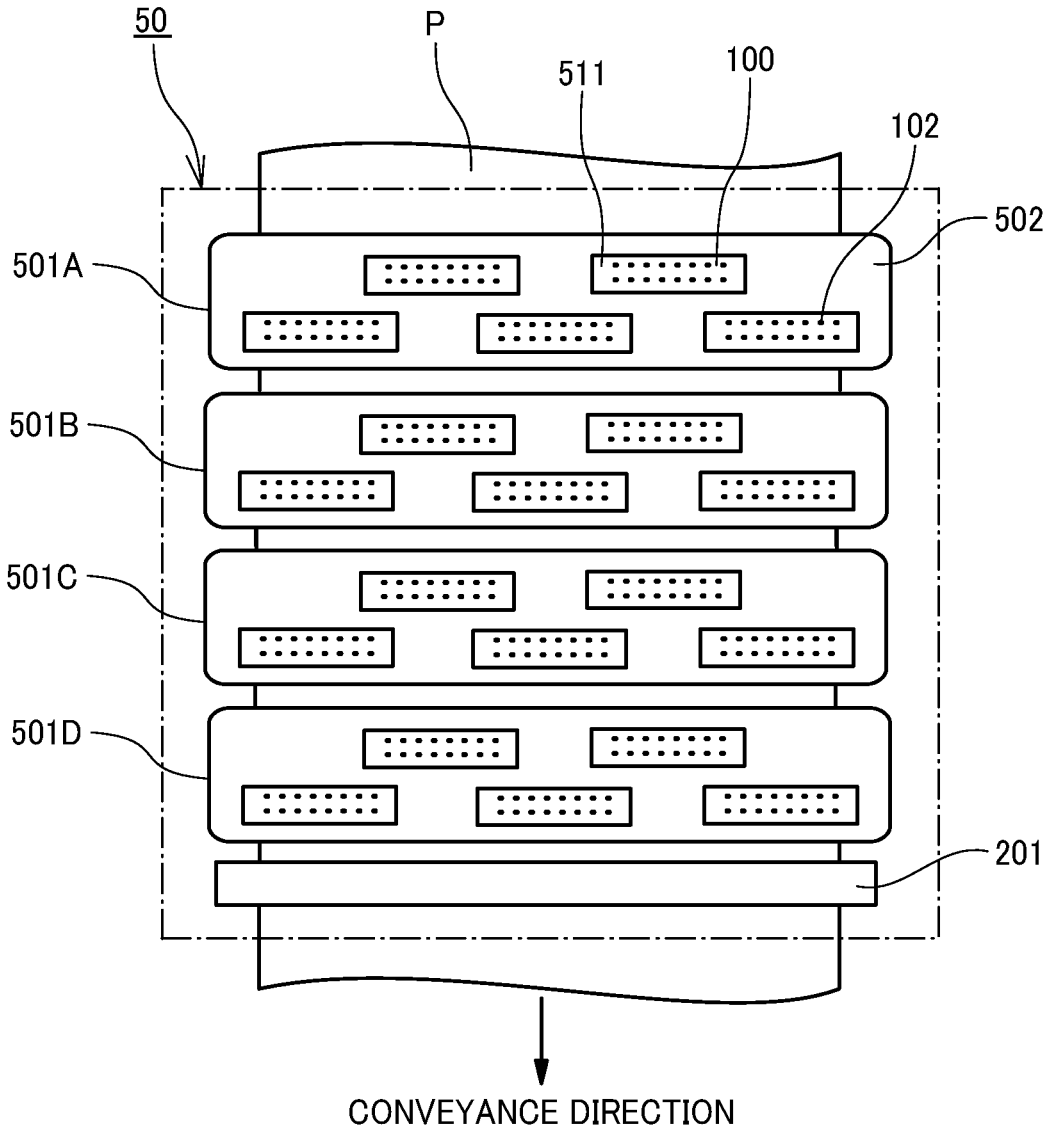
FIG. 14 is a plan view of a printing unit of the printer of FIG. 13.

The head array 501A and 501B are also collectively and simply referred to as the "head array 501." A gap of about several millimeters is formed between a nozzle surface 511 (discharge surface) of a head 100 (see FIG. 14) in the head array 501 and a sheet. The head array 501 includes a plurality of heads 100 as illustrated in FIG. 14. The head 100 is also referred to as a "liquid discharge head" to discharge a liquid from nozzles 102 formed on the nozzle surface 511 of the head 100 (see FIG. 14).

The liquid discharge apparatus 1 includes the adhesion part 201 on a downstream of the head array 501B in a conveyance direction of the sheet P as indicated by arrow in FIG. 1. A mist generated by the liquid discharge operation of the head array 501 is attachable to the adhesion part 201.

Figure 8:
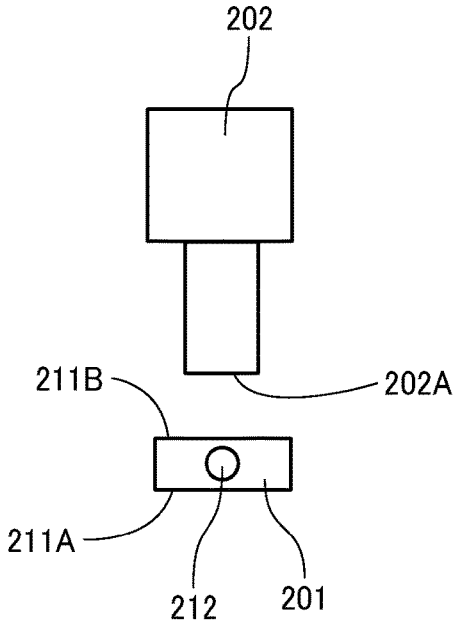
FIG. 8 is a schematic partial side view of the liquid discharge apparatus according to a third embodiment of the present disclosure.
Figure 9A:
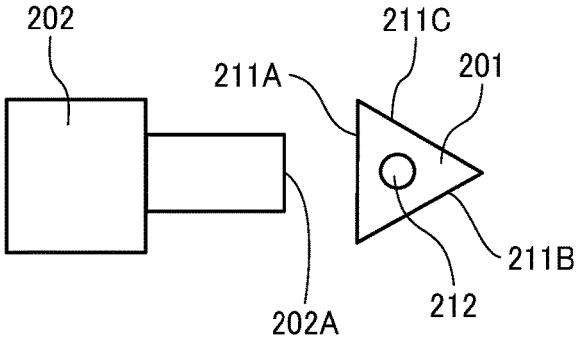
FIGS. 9A and 9B are schematic partial side views of the liquid discharge apparatus according to a fourth embodiment of the present disclosure.
Figure 9B:
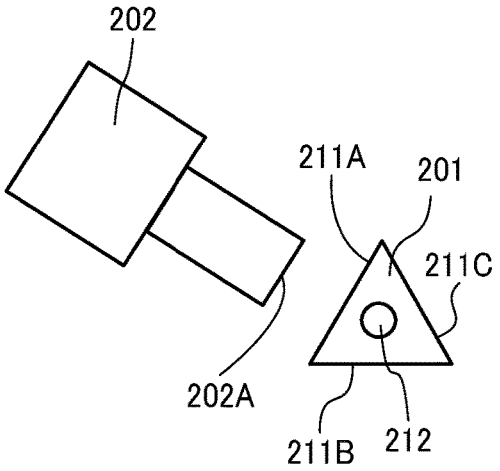

The adhesion part 201 includes an adhesion surface 211 to which the mist attaches. The liquid discharge apparatus 1 according to the first embodiment includes the adhesion part 201 having a square columnar shape and having a quadrangular cross section. Thus, a cross section of the adhesion part 201 has a polygonal shape. The polygonal shape of the cross section of the adhesion part 201 includes a quadrangle shape as illustrated in FIGS. 1 to 7, a plate-like shape as illustrated in FIG. 8, and a triangle shape as illustrated in FIGS. 9A and 9B.

The adhesion part 201 includes a plurality of surfaces (four surfaces in FIG. 1) used as adhesion surfaces 211 (211A to 211D). Alternatively, one to three surfaces of the adhesion part 201 may be used as the adhesion surface 211.

The adhesion part 201 is rotatable around a support axis 212 so that the adhesion surfaces 211 are rotatably movable around the support axis 212. The adhesion surface 211 of the adhesion part 201 is at a position facing the sheet P and has substantially the same (including the same) height as the nozzle surface 511 of the head array 501. The "substantially the same height" means that the height is within a range of 1 mm below the nozzle surface 511 and 15 mm above the nozzle surface 511.

The adhesion surface 211 is arranged at a height at which the adhesion part 201 does not interfere with the sheet P by a rotation of the adhesion part 201. When the adhesion part 201 is positioned at a position facing the sheet P, mist is attached to the adhesion surface 211 of the adhesion part 201.

The liquid discharge apparatus 1 includes a detector 202 on a downstream of the adhesion part 201 in the conveyance direction of the sheet P. The detector 202 detects a state of the adhesion surface 211 of the adhesion part 201 (a surface state of the adhesion part 201). The detector 202 includes an imaging device such as an optical sensor or a charge coupled device (CCD) camera. The detector 202 has a detection surface 202A on which a light is incident. For example, the detector 202 includes a lens as the detection surface 202A.

The detector 202 has a detection surface 202A. The detection surface 202A of the detector 202 is arranged above the sheet P to be conveyed, similarly to the head array 501 and the adhesion part 201. The detector 202 detects the surface state of the adhesion surface 211 of the adhesion part 201 from a lateral side (left side in FIG. 1) of the adhesion part 201.

The detection surface 202A of the detector 202 is arranged above the nozzle surface 511 of the head array 501 in a liquid discharge direction of the head array 501. The nozzle surface 511 of the head array 501 serves as the discharge surface of the liquid discharge device. The head 100 of the head array 501 discharges a liquid in the liquid discharge direction. Thus, the liquid discharge apparatus 1 can reduce an adhesion of the mist to the detection surface 202A of the detector 202.

The adhesion surface 211 of the adhesion part 201 and the detection surface 202A of the detector 202 is arranged on a same side of the head array 501 (liquid discharge device) with reference to the sheet P as an application target. Thus, the liquid discharge apparatus 1 to apply liquid to a continuous body such as a continuous paper can detect an adhesion state of mist.

Thus, the nozzle surface 511 (discharge surface) of the head array 501 (liquid discharge device), the adhesion surface 211 of the adhesion part 201, and the detection surface 202A of the detector 202 are arranged on a same side with respect to the sheet P (discharge target).

Further, the liquid discharge apparatus 1 includes a cleaner 203 as a cleaning device to wipe and clean the adhesion surface 211 of the adhesion part 201 above a top surface of the adhesion surface 211 of the adhesion part 201 as illustrated in FIG. 3. The cleaner 203 is movable along an axial direction of the support axis 212 of the adhesion part 201.

The cleaner 203 has a shape of a blade. A longitudinal direction of the cleaner 203 is arranged perpendicular to an axial direction of the support axis 212 of the adhesion part 201. The cleaner 203 moves in the axial direction of the support axis as indicated by arrow in FIG. 3. The cleaner 203 may be made of a flexible material such as rubber, sponge, and the like.

Figure 2A:
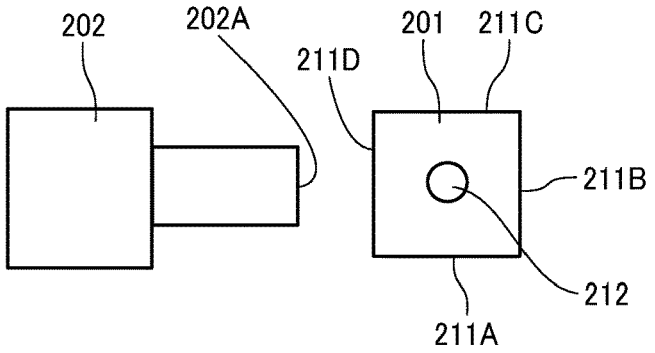
FIGS. 2A to 2D are partial front views of liquid discharge apparatus illustrating a rotation position of an adhesion part.
Figure 2B:
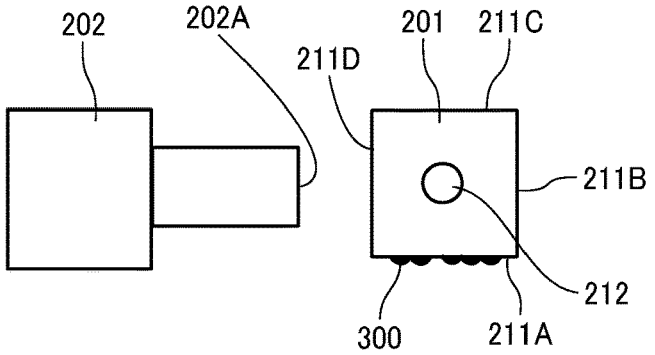
Figure 2C:
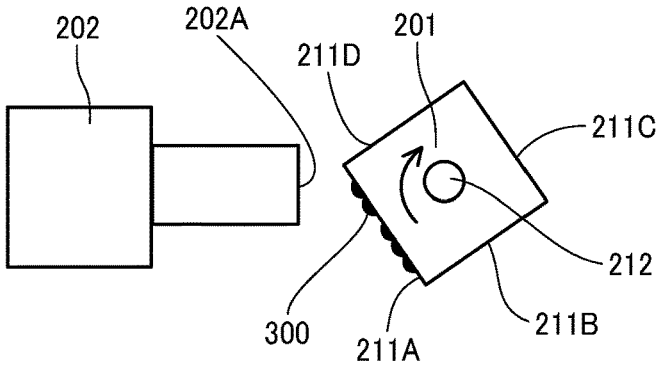
Figure 2D:
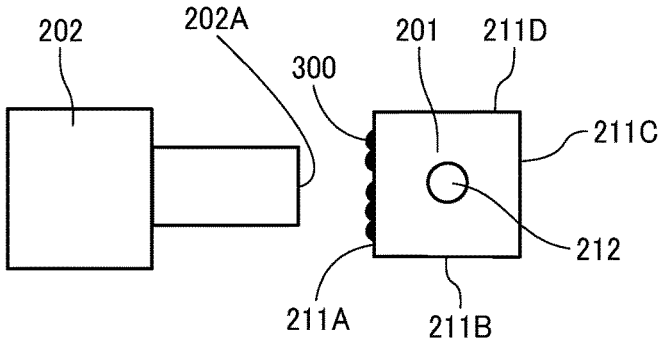

The liquid discharge apparatus 1 according to the first embodiment can rotate the adhesion part 201 around the support axis 212 to move the adhesion surface 211 to a mist adhesion position as illustrated in FIG. 2A, a detection position as illustrated in FIG. 2D, and a cleaning position as illustrated in FIG. 3. The detector 202 detects the adhesion surface 211 of the adhesion part 201 at the detection position. The cleaner 203 cleans the adhesion surface 211 of the adhesion part 201 at the cleaning position.

Thus, the adhesion part 201 can change (switch) the adhesion surface 211 facing the detection surface 202A of the detector 202.

Further, the plurality of adhesion surfaces 211 includes a first adhesion surface 211 at the mist adhesion position, a second adhesion surface 211 at the detection position, and a third adhesion surface 211 at the cleaning position, and the adhesion part 201 rotates to change (switch) positions of the first adhesion surface 211, the second adhesion surface 211, and the third adhesion surface 211.

The mist adhesion position is a position at which the adhesion surface 211 faces the sheet P so that the mist easily adheres the adhesion surface 211 of the adhesion part 201. The detection position is a position at which the adhesion surface 211 of the adhesion part 201 faces the detection surface 202A of the detector 202 so that the detector 202 can detect the adhesion surface 211 of the adhesion part 201. The cleaning position is a position at which the cleaner 203 can wipe and clean the adhesion surface 211 of the adhesion part 201.

Here, the liquid discharge apparatus 1 has a configuration to use four adhesion surfaces 211 of the adhesion part 201. Thus, the adhesion part 201 is rotated in one direction (clockwise direction in FIG. 2C). The detection surface 202A of the detector 202 and the cleaner 203 are arranged at positions facing different adhesion surfaces 211 of the adhesion part 201. For example, the detection surface 202A of the detector 202 faces a left side of the adhesion surface 211 of the adhesion part 201, and the cleaner 203 faces a top side of the adhesion surface 211 of the adhesion part 201 in FIG. 1.

Thus, when the adhesion surface 211A is at the mist adhesion position, the adhesion surface 211D is at the detection position, and the adhesion surface 211C is at the cleaning position, for example as illustrated in FIGS. 2A and 2B. The adhesion part 201 is rotated by 90 degree from the above described state in the clockwise direction as illustrated in FIG. 2C so that the adhesion surface 211A moves to the detection position, the adhesion surface 211D moves to the cleaning position, and the adhesion surface 211B moves to the mist adhesion position as illustrated in FIG. 2D.

As described above, the liquid discharge apparatus 1 has a configuration having one surface as the adhesion surface 211 so that the adhesion surface 211 can reciprocally move between the mist adhesion position, the detection position, and the cleaning position, for example.

Here, a rotation operation of the adhesion part 201 and the movement of the adhesion surface 211 are described below with reference to FIGS. 2A to 2D.

As illustrated in FIG. 2A, the adhesion surface 211A of the adhesion part 201 is set to the mist adhesion position. Thus, the mist 300 generated by the liquid discharged from the head array 501 adheres to the adhesion surface 211A as illustrated in FIG. 2B, for example.

Therefore, the adhesion part 201 is rotated in the clockwise direction as indicated by arrow as illustrated in FIG. 2C at a predetermined timing. Thus, the adhesion surface 211A to which the mist 300 is adhered is moved to the detection position detectable by the detector 202 as illustrated in FIG. 2D.

In this state in which the adhesion surface 211A is at the detection position, the detector 202 detects the surface state of the adhesion surface 211A of the adhesion part 201 and detects a degree of dirt (dirty state) of the adhesion surface 211A by the mist.

At this time, the next adhesion surface 211B moves to the mist adhesion position.

Figure 4:
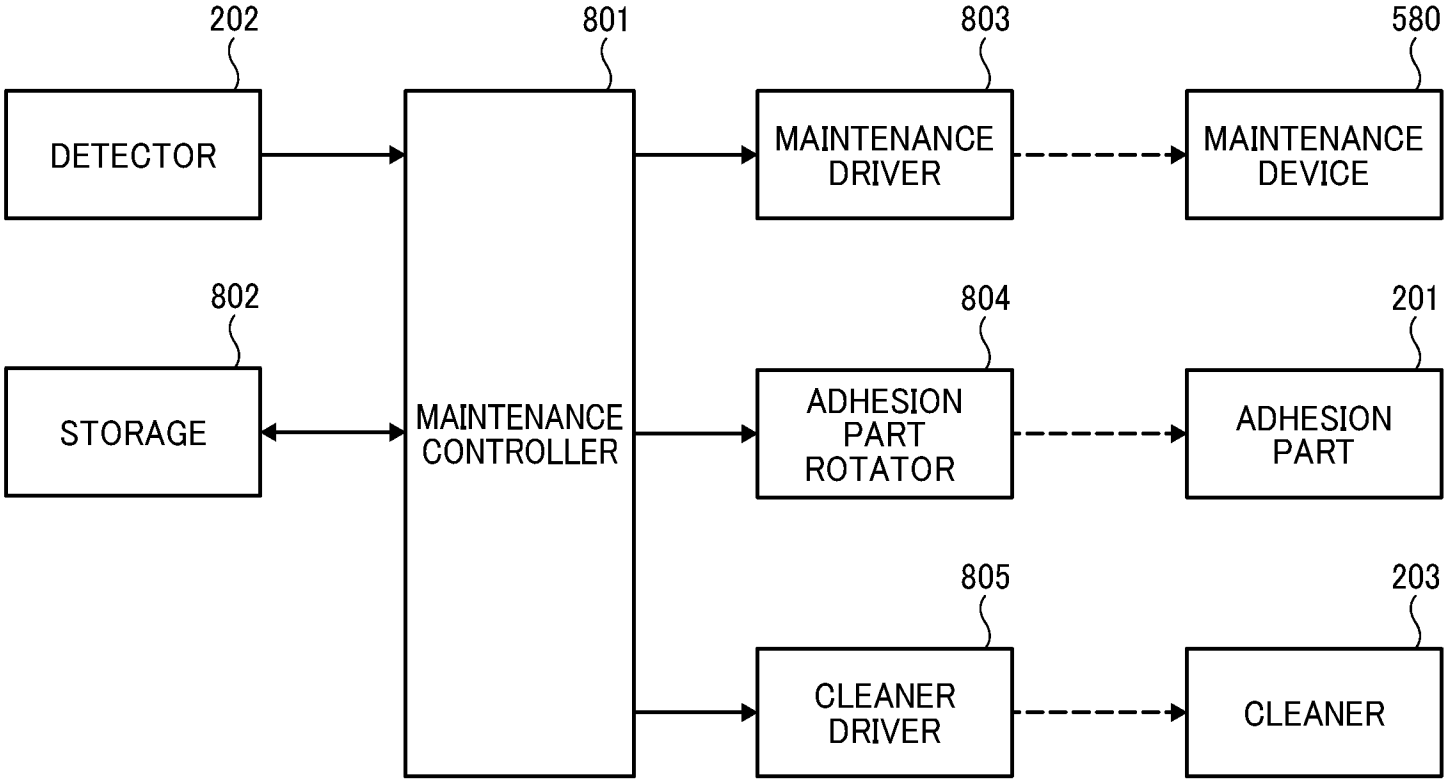
FIG. 4 is a block diagram of a functional configuration of the liquid discharge apparatus 1 related to a maintenance control according to the first embodiment of the present disclosure.

FIG. 4 is a block diagram of a functional configuration of the liquid discharge apparatus 1 related to a maintenance control according to the first embodiment of the present disclosure.

The maintenance controller 801 inputs a detection value of the surface state of the adhesion surface 211 of the adhesion part 201 from the detector 202. The detection value of the detector 202 depends on the degree of dirt (dirty state) of the adhesion surface 211.

The maintenance controller 801 stores detection values detected by the detector 202 in a rewritable storage 802 while integrating the detection values. The maintenance controller 801 resets an integrated value and returned to an initial state when a maintenance operation is performed.

Then, the maintenance controller 801 controls a maintenance device 580 to perform a maintenance operation when the integrated value of the detection values of the detector 202 becomes equal to or more than a predetermined threshold value.

The maintenance device 580 includes a suction cap to cap the nozzle surface 511 of the head 100 and a wiper to wipe the nozzle surface 511 of the head 100. The maintenance controller 801 drives and controls the maintenance driver 803 to control maintenance operations such as a suction operation by the suction cap of the maintenance device 580 and a wiping operation by the wiper.

The liquid discharge apparatus 1 includes an adhesion part rotator 804 such as a drive motor to rotate the adhesion part 201. The maintenance controller 801 drives the adhesion part rotator 804 to rotate the adhesion part 201.

Further, the maintenance controller 801 controls the cleaner driver 805 to move the cleaner 203 to wipe and clean the adhesion surface 211.

Thus, the adhesion part 201 is configured to move to switch a position of the adhesion surface 211 from the mist adhesion position facing the sheet P (discharge target) to the detection position facing the detection surface 202A of the detector 202.

Next, control of the maintenance operation according to the first embodiment is described with reference to FIGS. 5 and 6.

FIG. 5 is a table illustrating timing of the maintenance operation.

Figure 6:
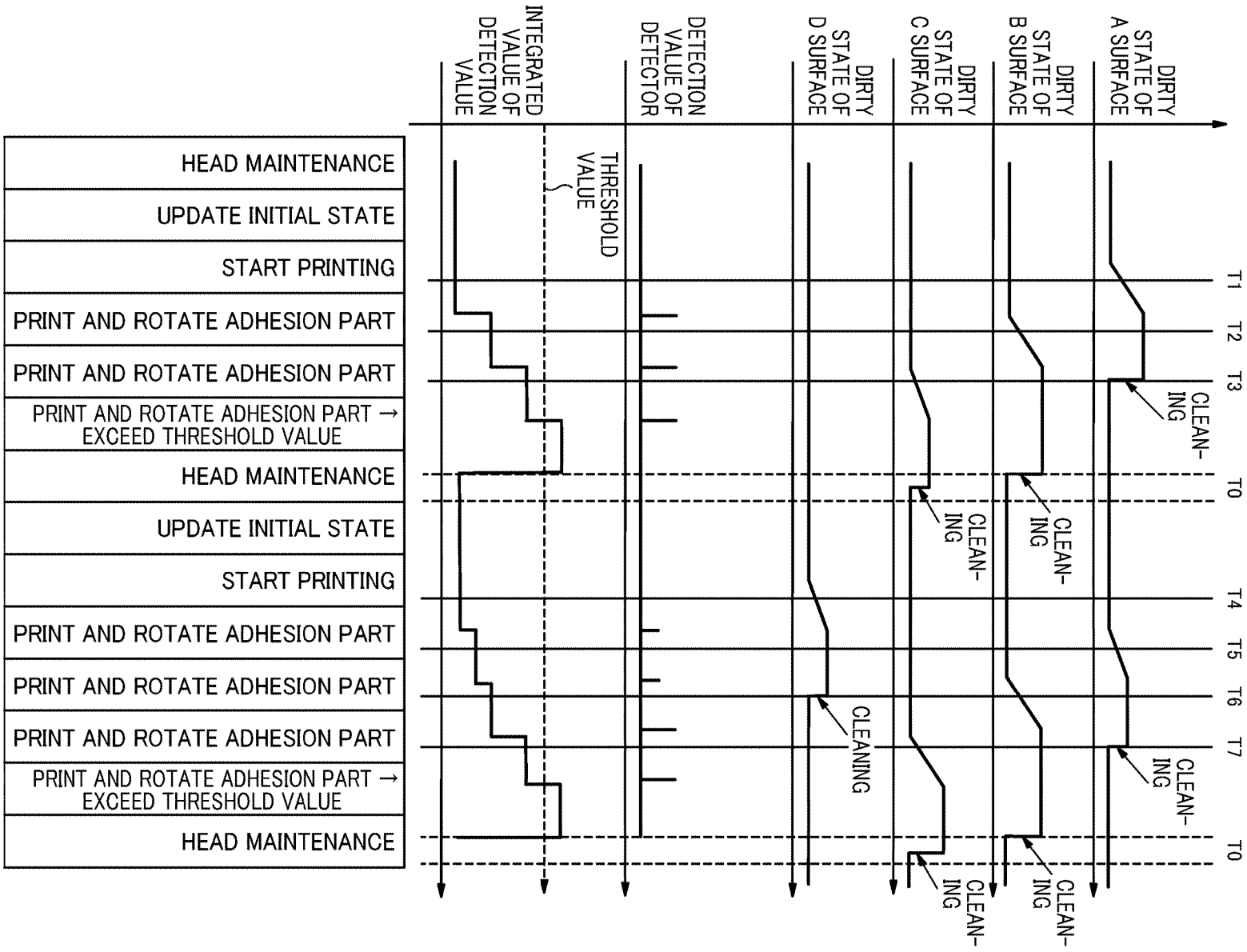
FIG. 6 is a timing chart of the maintenance operation according to the first embodiment of the present disclosure.

FIG. 6 is a timing chart of the maintenance operation in the first embodiment. In FIGS. 5 and 6, the adhesion surface 211A is simply referred to as a "A surface."

The maintenance controller 801 controls a head maintenance operation and updates an initial state of the dirty state of the adhesion surface 211 stored in the storage 802. Then, the liquid discharge apparatus 1 starts a printing operation as a liquid discharge operation to discharge a liquid from the head array 501.

Each positions of the adhesion surfaces 211A to 211D of the adhesion part 201 at each time point T1 to T0 and T5 to T0 after the liquid discharge operation in FIG. 6 are illustrated in FIG. 5.

That is, at the time points T1 and T5, the adhesion surface 211A is at the mist adhesion position facing the sheet P, the adhesion surface 211B is at a waiting position, the adhesion surface 211C is at the cleaning position to be cleaned by the cleaner 203, and the adhesion surface 211D is at the detection position to be detected by the detector 202 as illustrated in FIGS. 2A and 5.

Thus, at the time points T2 and T6 after the adhesion part 201 is rotated by 90 degrees from the time points T1 and T5, the adhesion surface 211A is at the detection position, the adhesion surface 211B is at the mist adhesion position, the adhesion surface 211C is at the waiting position, and the adhesion surface 211D is at the cleaning position as illustrated in FIGS. 2D and 5.

At the time points T3 and T7 after the adhesion part 201 is rotated by 90 degrees from the time points T2 and T6, the adhesion surface 211A is at the cleaning position, the adhesion surface 211B is at the detection position, the adhesion surface 211C is at the mist adhesion position, and the adhesion surface 211D is at the waiting position.

The maintenance controller 801 performs the head maintenance operation at the time point T01 after the adhesion part 201 is rotated by 90 degrees from the time point T3.

At the time point T4, the initial state is updated after the head maintenance operation is performed, and printing operation is started. At the time point T4 after the adhesion part 201 is rotated by 90 degrees from the time point T3, the adhesion surface 211A is at the waiting position, the adhesion surface 211B is at the cleaning position, the adhesion surface 211C is at the detection position, and the adhesion surface 211D is at the mist adhesion position.

Referring to FIG. 6, at the time point T1 after the start of printing operation, the mist 300 adheres to the adhesion surface 211A of the adhesion part 201 along with the printing operation, and the dirty state of the adhesion surface 211A increases as illustrated in a "dirty state of A surface" in FIG. 6.

Then, the maintenance controller 801 rotates the adhesion part 201 at a predetermined timing to move the adhesion surfaces 211A to 211D to the above-described positions at the timing point T2, respectively.

Thus, the adhesion surface 211A moves to the detection position to be detected by the detector 202. Thus, the detector 202 detects the dirty state of the adhesion surface 211A, and the maintenance controller 801 stores and holds the detection value in the storage 802 as the integrated value as illustrated in an "integrated value of detection value" at the time point T2 in FIG. 6. At this time, the maintenance controller 801 compares the integrated value stored in the storage 802 with the predetermined threshold value. Because the integrated value is smaller than the predetermined threshold value, the maintenance controller 801 continues processes as illustrated in FIG. 6.

Then, the adhesion surface 211B has moved to the mist adhesion position by the rotation of the adhesion part 201. Thus, the mist 300 adheres to the adhesion surface 211B, and the dirt state of the adhesion surface 211B becomes high as illustrated in a "dirty state of B surface" in FIG. 6.

Then, the maintenance controller 801 rotates the adhesion part 201 at a predetermined timing to move the adhesion surfaces 211A to 211D to the above-described positions at the time point T3, respectively.

Thus, the adhesion surface 211B moves to the detection position to be detected by the detector 202. Thus, the detector 202 detects the dirty state of the adhesion surface 211B, and the maintenance controller 801 stores and holds the detection value in the storage 802 as the integrated value as illustrated in an "integrated value of detection value" at the time point T3 in FIG. 6. At this time, the maintenance controller 801 compares the integrated value stored in the storage 802 with the predetermined threshold value. Because the integrated value is smaller than the predetermined threshold value, the maintenance controller 801 continues the processes as illustrated in FIG. 6.

Then, the adhesion surface 211C has moved to the mist adhesion position by the rotation of the adhesion part 201. Thus, the mist 300 adheres to the adhesion surface 211C, and the dirt state of the adhesion surface 211C becomes high as illustrated in a "dirty state of C surface" in FIG. 6.

Then, the maintenance controller 801 rotates the adhesion part 201 at a predetermined timing to move the adhesion surfaces 211A to 211D to the above-described positions at the timing point T4, respectively.

Thus, the adhesion surface 211C moves to the detection position to be detected by the detector 202. Thus, the detector 202 detects the dirty state of the adhesion surface 211B, and the maintenance controller 801 stores and holds the detection value in the storage 802 as the integrated value as illustrated in an "integrated value of detection value" at the time point T0 in FIG. 6. At this time, the maintenance controller 801 compares the integrated value stored in the storage 802 with the predetermined threshold value.

Since the integrated value is equal to or greater than the threshold value in this comparison result, the maintenance controller 801 performs the head maintenance operation. During this head maintenance operation, the maintenance controller 801 rotates the adhesion part 201 and wipes and cleans the adhesion surface 211 with the cleaner 203.

After end of the head maintenance operation, the maintenance controller 801 updates the initial state and starts a next printing operation.

At this time, the adhesion surfaces 211A to 211D of the adhesion part 201 has moved to the above-described positions at the time point T4, respectively. Thus, the mist 300 adheres to the adhesion surface 211D, and the dirt state of the adhesion surface 211D becomes high as illustrated in a "dirty state of D surface" in FIG. 6 when the printing operation is stated.

Then, the maintenance controller 801 rotates the adhesion part 201 at a predetermined timing to move the adhesion surfaces 211A to 211D to the above-described positions at the timing point T5, respectively.

Thus, the adhesion surface 211D moves to the detection position to be detected by the detector 202. Thus, the detector 202 detects the dirty state of the adhesion surface 211D, and the maintenance controller 801 stores and holds the detection value in the storage 802 as the integrated value as illustrated in an "integrated value of detection value" at the time point T5 in FIG. 6. At this time, the maintenance controller 801 compares the integrated value stored in the storage 802 with the predetermined threshold value. Because the integrated value is smaller than the predetermined threshold value, the maintenance controller 801 continues the processes as illustrated in FIG. 6.

Then, the adhesion surface 211A has moved to the mist adhesion position by the rotation of the adhesion part 201. Thus, the mist 300 adheres to the adhesion surface 211A, and the dirt state of the adhesion surface 211A becomes high as illustrated in a "dirty state of A surface" in FIG. 6.

Then, the maintenance controller 801 rotates the adhesion part 201 at a predetermined timing to move the adhesion surfaces 211A to 211D to the above-described positions at the timing point T6, respectively.

Thus, the adhesion surface 211A moves to the detection position to be detected by the detector 202. Thus, the detector 202 detects the dirty state of the adhesion surface 211A, and the maintenance controller 801 stores and holds the detection value in the storage 802 as the integrated value as illustrated in an "integrated value of detection value" at the time point T6 in FIG. 6.

At this time, the maintenance controller 801 compares the integrated value stored in the storage 802 with the predetermined threshold value. Because the integrated value is smaller than the predetermined threshold value, the maintenance controller 801 continues the processes as illustrated in FIG. 6.

Then, the adhesion surface 211B has moved to the mist adhesion position by the rotation of the adhesion part 201. Thus, the mist 300 adheres to the adhesion surface 211B, and the dirt state of the adhesion surface 211B becomes high as illustrated in a "dirty state of B surface" in FIG. 6.

Then, the maintenance controller 801 rotates the adhesion part 201 at a predetermined timing to move the adhesion surfaces 211A to 211D to the above-described positions at the timing point T7, respectively.

Thus, the adhesion surface 211B moves to the detection position to be detected by the detector 202. Thus, the detector 202 detects the dirty state of the adhesion surface 211B, and the maintenance controller 801 stores and holds the detection value in the storage 802 as the integrated value as illustrated in an "integrated value of detection value" at the time point T7 in FIG. 6.

At this time, the maintenance controller 801 compares the integrated value stored in the storage 802 with the predetermined threshold value. Because the integrated value is smaller than the predetermined threshold value, the maintenance controller 801 continues the processes as illustrated in FIG. 6.

Then, the adhesion surface 211C has moved to the mist adhesion position by the rotation of the adhesion part 201. Thus, the mist 300 adheres to the adhesion surface 211C, and the dirt state of the adhesion surface 211C becomes high as illustrated in a "dirty state of C surface" in FIG. 6.

Then, the maintenance controller 801 rotates the adhesion part 201 at a predetermined timing to move the adhesion surfaces 211A to 211D to the positions same as the above-described positions at the timing point T4, respectively.

Thus, the adhesion surface 211C moves to the detection position to be detected by the detector 202. Thus, the detector 202 detects the dirty state of the adhesion surface 211C, and the maintenance controller 801 stores and holds the detection value in the storage 802 as the integrated value as illustrated in an "integrated value of detection value" at the time point T0 in FIG. 6. At this time, the maintenance controller 801 compares the integrated value stored in the storage 802 with the predetermined threshold value.

Since the integrated value is equal to or greater than the threshold value in this comparison result, the maintenance controller 801 performs the head maintenance operation.

During the liquid discharge apparatus 1 performs the above described printing operation (liquid discharge operation) or the maintenance operation, the maintenance controller 801 rotates the adhesion part 201 and controls the cleaner 203 to wipe and clean the adhesion surface 211A to 211D moved to the cleaning position. The mist adheres to the adhesion surface 211A to 211D at the cleaning position. For example, at the time point T3 in FIG. 6, the dirt state is initialized by cleaning the adhesion surface 211A.

Thus, the cleaner 203 may clean the adhesion surface 211 of the adhesion part 201 while the head array 501 (liquid discharge device) discharges the liquid. Further, the cleaner 203 may clean the adhesion surface 211 of the adhesion part 201 while the head array 501 (liquid discharge device) is maintained by the maintenance device 580.

Further, the maintenance controller 801 according to the first present embodiment may arbitrarily set the predetermined timing to rotate the adhesion part 201 at every predetermined timing. For example, the maintenance controller 801 may rotate the adhesion part 201 at predetermined time intervals, rotate the adhesion part 201 every time a number of liquid discharge from the head array 501 as the liquid discharge device reaches a predetermined number of times, or rotate the adhesion part 201 every time an amount of liquid discharge reaches a predetermined discharge amount.

Thus, the liquid discharge apparatus 1 according to the first embodiment includes the detector 202 arranged at same side of the adhesion part 201 and the head array 501 (liquid discharge device) with respect to the sheet P to be conveyed. The detector 202 detects the surface state of the adhesion surface 211 of the adhesion part 201.

Thus, even if the liquid discharge apparatus 1 is a continuous feed printer to print on a continuous body as the sheet P always facing to the head array 501 (liquid discharge device), the detector 202 can detect the surface state (dirty state by the mist) of the adhesion part 201 to which the mist adheres.

Further, since the detector 202 to detect the surface state (dirty state) of the adhesion surface 211 of the adhesion part 201 does not face the head array 501 (liquid discharge device), the liquid discharge apparatus 1 can prevent the mist to adhere to the detector 202 that lowers the detection accuracy of the detector 202.

The liquid discharge apparatus 1 according to a second embodiment of the present disclosure is described with reference to FIG. 7.

Figure 7:
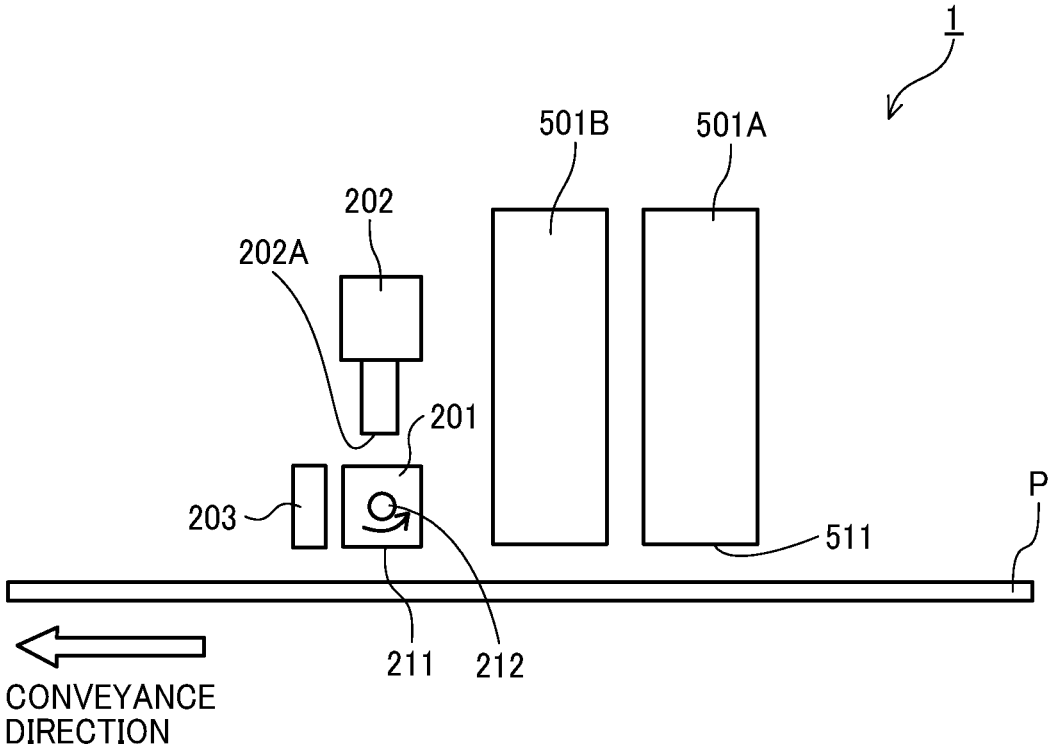
FIG. 7 is a schematic side view of the liquid discharge apparatus according to a second embodiment of the present disclosure.

FIG. 7 is a schematic side view of the liquid discharge apparatus 1 according to the second embodiment.

The liquid discharge apparatus 1 according to the second embodiment includes the detection surface 202A of the detector 202 according to the first embodiment arranged above the adhesion part 201. The cleaner 203 is arranged on the lateral side (left side in FIG. 7) of the adhesion part 201. The rotation direction of the adhesion part 201 in the second embodiment is a counterclockwise direction indicated by arrow in FIG. 7 that is opposite to the rotation direction of the adhesion part 201 according to the first embodiment as illustrated in FIG. 2C.

Thus, the detector 202 is arranged above the adhesion part 201 with the detection surface 202A facing downward to the adhesion part 201. Thus, the liquid discharge apparatus 1 can reduce an adhesion of the mist to the detection surface 202A of the detector 202 and can prevent reduction of the detection accuracy of the detector 202.

The liquid discharge apparatus 1 according to a third embodiment of the present disclosure is described with reference to FIG. 8.

FIG. 8 is a schematic partial side view of the liquid discharge apparatus 1 according to the third embodiment.

The liquid discharge apparatus 1 according to the third embodiment includes a flat plate-like member as the adhesion part 201. Two surfaces (front surface and back surface) of the adhesion part 201 are used as the adhesion surfaces 211.

The liquid discharge apparatus 1 according to a fourth embodiment of the present disclosure is described with reference to FIGS. 9A and 9B. FIGS. 9A and 9B are schematic partial side views of the liquid discharge apparatus 1 according to the fourth embodiment.

The liquid discharge apparatus 1 according to the fourth embodiment includes the adhesion part 201 having a shape of a triangular prism and having a triangular cross section. Three surfaces of the adhesion part 201 serve as the adhesion surfaces 211. In a first example illustrated in FIG. 9A, the detector 202 is arranged at a lateral side (left side in FIG. 9A) of the adhesion part 201 so that the detector 202 detects the adhesion surface 211 from the lateral side of the adhesion part 201. In a second example illustrated in FIG. 9B, the detector 202 is arranged diagonally above the adhesion part 201 so that the detector 202 detects the adhesion surface 211 from a position diagonally above the adhesion part 201.

Figure 10:
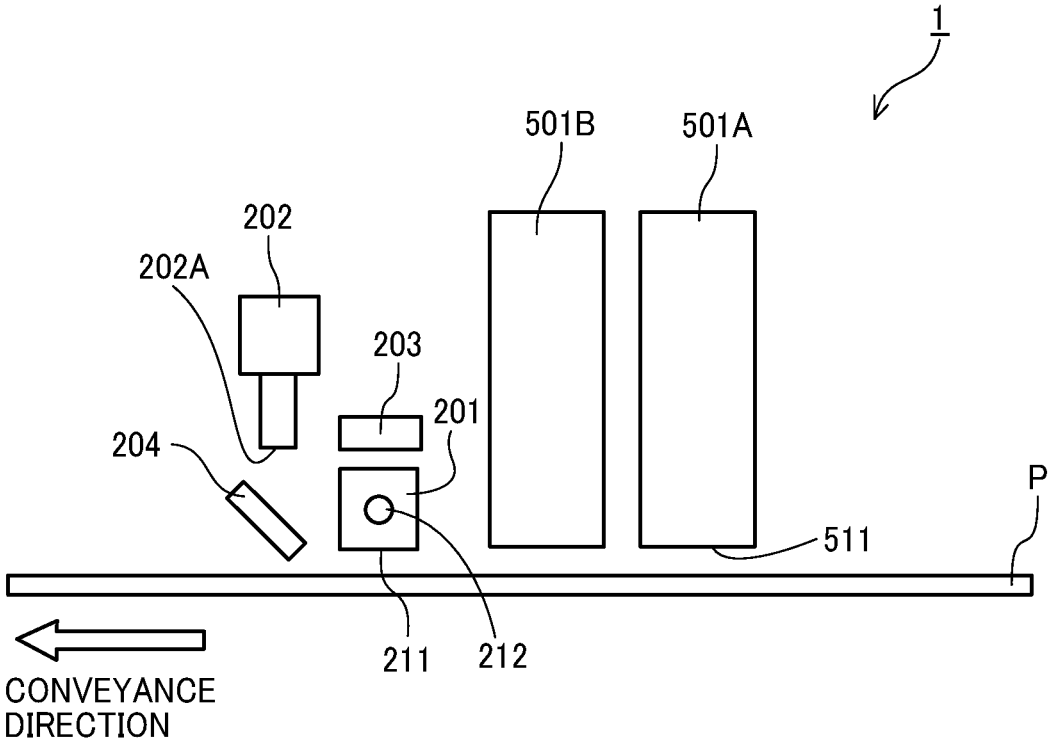
FIG. 10 is a schematic side view of the liquid discharge apparatus according to a fifth embodiment of the present disclosure.

Next, the liquid discharge apparatus 1 according to a fifth embodiment of the present disclosure is described with reference to FIG. 10. FIG. 10 is a schematic side view of the liquid discharge apparatus 1 according to the fifth embodiment.

The liquid discharge apparatus 1 according to the fifth embodiment includes the detector 202 and a mirror 204. The detection surface 202A of the detector 202 faces downward. The mirror 204 is diagonally arranged with respect to the detection surface 202A of the detector 202 and the adhesion surface 211 of the adhesion part 201. The detector 202 images the adhesion surface 211 of the adhesion part 201 through the mirror 204.

Thus, the liquid discharge apparatus 1 can increase selections of arrangement positions of the detector 202.

A liquid discharge apparatus 1 according to a sixth embodiment of the present disclosure is described with reference to FIGS. 11 and 12.

Figure 11:
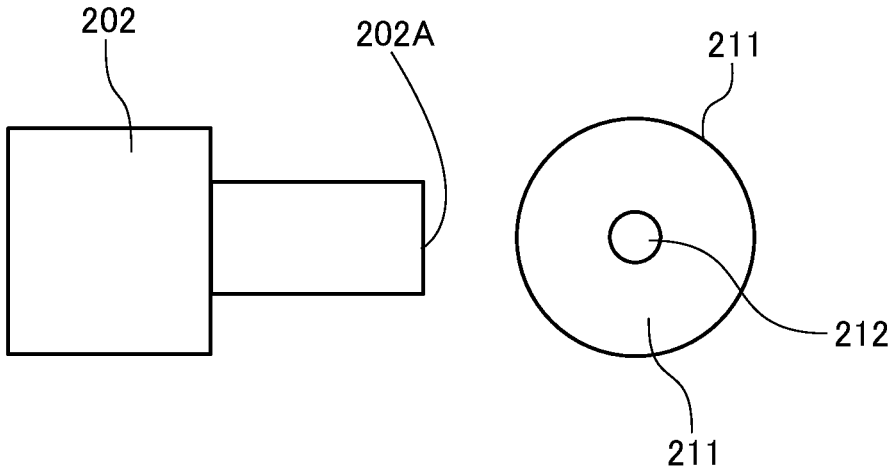
FIG. 11 is a schematic partial side view of the liquid discharge apparatus according to a sixth embodiment of the present disclosure.

FIG. 11 is a schematic partial side view of the liquid discharge apparatus 1 according to the sixth embodiment.

Figure 12:
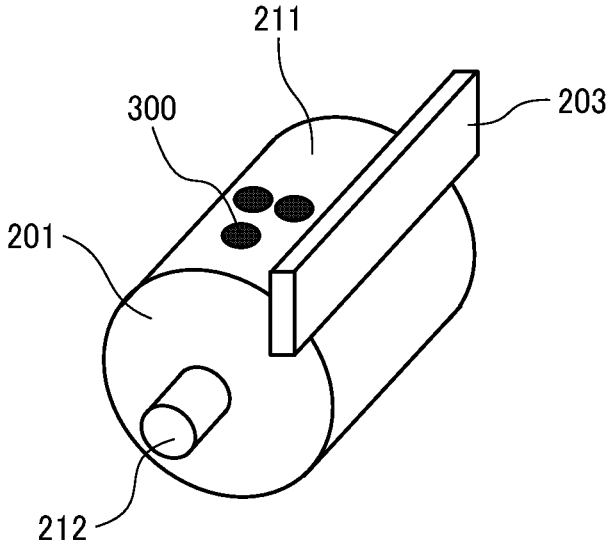
FIG. 12 is a schematic partial perspective view of the liquid discharge apparatus according to the sixth embodiment of the present disclosure.

FIG. 12 is a schematic partial perspective view of the liquid discharge apparatus 1 according to the sixth embodiment.

The liquid discharge apparatus 1 according to the sixth embodiment includes the adhesion part 201 having a columnar shape and having a circular cross section. A circumferential surface of the adhesion part 201 serves as the adhesion surfaces 211. The liquid discharge apparatus 1 includes the cleaner 203 above the adhesion part 201 as illustrated in FIG. 12. The cleaner 203 has a shape of a blade having a width equal to or larger a width of the adhesion part 201. A longitudinal direction of the cleaner 203 is along an axial direction of the support axis 212 of the adhesion part 201.

The liquid discharge apparatus 1 according to the sixth embodiment rotates the adhesion part 201 around the support axis 212 so that the liquid discharge apparatus 1 can continuously and sequentially perform a detection of the dirty state (surface state) of the adhesion surface 211 of the adhesion part 201 by the detector 202 and a cleaning of the adhesion surface 211 of the adhesion part 201 by the cleaner 203.

Thus, the adhesion part 201 rotates while the head array 501 (liquid discharge device) discharges the liquid, and a cleaning operation of the cleaner 203 to clean the adhesion surface 211 and a detection operation of the detector 202 to detect the surface state of the adhesion surface 211 are sequentially performed during a rotation of the adhesion part 201.

Figure 13:
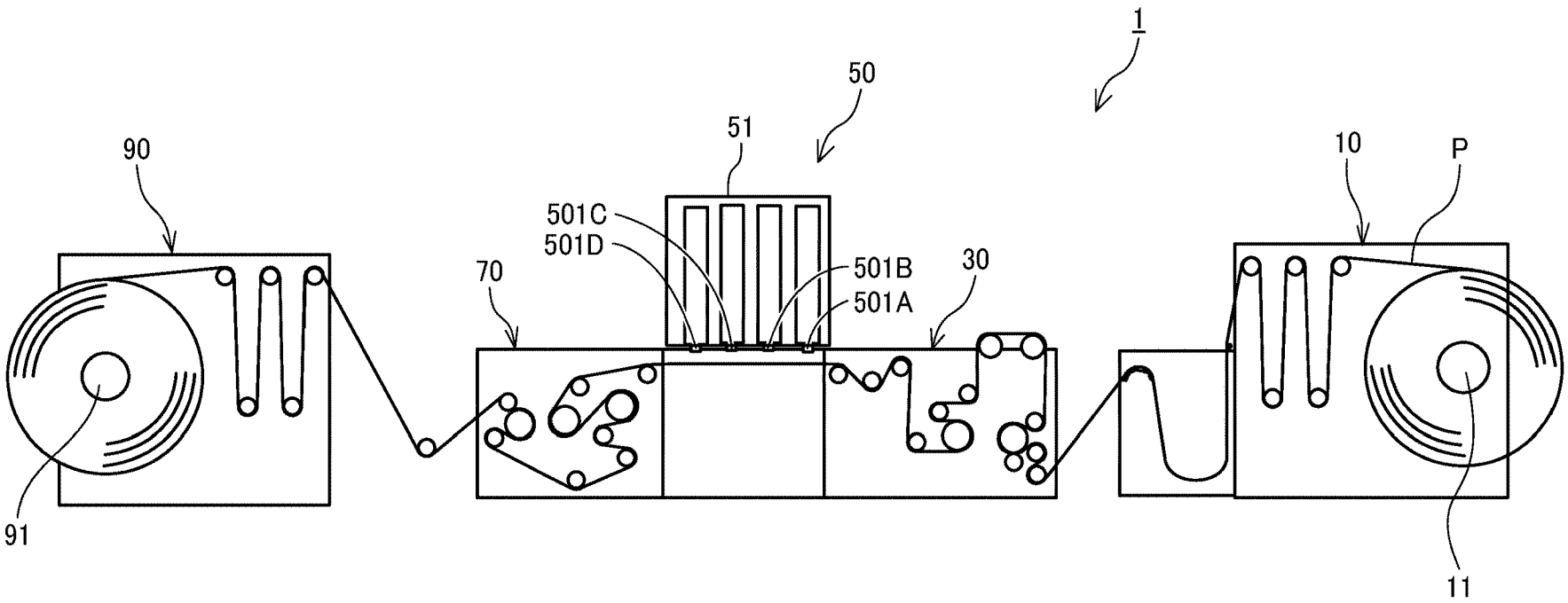
FIG. 13 is a schematic side view of a printer as a liquid discharge apparatus according to a seventh embodiment of the present disclosure.

Next, an example of a printer as a liquid discharge apparatus 1 according to a seventh embodiment of the present disclosure is described with reference to FIGS. 13 and 14. FIG. 13 is a schematic cross-sectional front view of the printer (liquid discharge apparatus 1) according to the seventh embodiment of the present disclosure. FIG. 14 is a plan view of a printing unit 50 according to the seventh embodiment.

A printer is the liquid discharge apparatus 1 and includes a loader 10, a guide conveyor 30, a printing unit 50, a dryer 70, and an ejector 90.

The loader 10 loads a sheet P such as a continuous sheet. The guide conveyor guides and conveys the sheet P loaded by the loader 10 to the printing unit 50. The printing unit 50 discharges a liquid onto the sheet P to form an image on the sheet P as a printing process. The dryer 70 heats and dries the sheet P onto which a liquid is applied, for example. The ejector 90 ejects the sheet P conveyed from the dryer 70.

The sheet P is fed from a winding roller 11 of the loader 10, guided and conveyed with rollers of the loader 10, the guide conveyor 30, the dryer 70, and the ejector 90, and wound around a take-up roller 91 of the ejector 90.

In the printing unit 50, the sheet P is conveyed to face a discharge unit 51, and an image is printed on the sheet P by the liquid discharged from the discharge unit 51.

Here, in the discharge unit 51, for example, full-line head arrays 501 (501A to 501D) for four colors are arranged from an upstream side in a conveyance direction of the sheet P as indicated by arrow in FIG. 14.

The head arrays 501A, 501B, 501C, and 501D are liquid discharge devices to discharge liquids of, for example, black (K), cyan (C), magenta (M), and yellow (Y) onto the sheet P conveyed. Note that number and types of color are not limited to the above-described four colors of K, C, M, and Y and may be any other suitable number and types.

In each of the head array 501, a plurality of heads 100 is arranged in a staggered manner in a conveyance direction of the sheet P on a base 502. Each of the plurality of heads 100 discharges a liquid.

In the head 100, a plurality of nozzles 102, from which a liquid is discharged, is arranged on the nozzle surface 511 of the head 100 of the head array 501. The nozzle surface 511 in FIG. 14 corresponds to the nozzle surface 511 in FIG. 1.

Further, the liquid discharge apparatus 1 in the seventh embodiment includes the adhesion part 201 and the like as described in one of the first to sixth embodiments. The adhesion part 201 is arranged on the most downstream side of the head array 501.

Further, "liquid" discharged from the head is not particularly limited as long as the liquid has a viscosity and surface tension of degrees dischargeable from the head. Preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source in the head to generate energy to discharge liquid from the head include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The term "liquid discharge apparatus" used herein also represents an apparatus including the head to discharge liquid by driving the head. The liquid discharge apparatus may be, for example, an apparatus capable of discharging liquid to a material to which liquid can adhere or an apparatus to discharge liquid toward gas or into liquid.

The "liquid discharge apparatus" may include units to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material on which liquid can adhere" represents a material on which liquid is at least temporarily adhered, a material on which liquid is adhered and fixed, or a material into which liquid is adhered to permeate.

Examples of the "material onto which liquid can adhere" include recording media such as a paper sheet, recording paper, a recording sheet of paper, film, and cloth, electronic components such as an electronic substrate and a piezoelectric element, and media such as a powder layer, an organ model, and a testing cell. The "material onto which liquid can adhere" includes any material on which liquid adheres unless particularly limited.

Examples of the "material on which liquid can adhere" include any materials on which liquid can adhere even temporarily, such as paper, thread, fiber, fabric, leather, metal, plastic, glass, wood, and ceramic.

The "liquid discharge apparatus" may be an apparatus to relatively move the head and a material on which liquid can adhere. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on the surface of the sheet to reform the sheet surface, and an injection granulation apparatus in which a composition liquid including raw materials dispersed in a solution is injected through nozzles to granulate fine particles of the raw materials.

The terms "image formation", "recording", "printing", "image printing", and "fabricating" used herein may be used synonymously with each other.

Each of the functions of the described embodiments such as the maintenance controller 801 may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge apparatus comprising:

a liquid discharge device configured to discharge a liquid onto a discharge target from nozzles on a discharge surface of the liquid discharge device in a liquid discharge direction;

an adhesion part including an adhesion surface to which mist of the liquid discharged by the liquid discharge device adheres; and a detector including a detection surface facing the adhesion surface of the adhesion part, the detector configured to detect a surface state of the adhesion surface of the adhesion part, wherein the detection surface of the detector is above the discharge surface of the liquid discharge device in the liquid discharge direction, and the adhesion part is configured to move to change the adhesion surface facing the detection surface of the detector.

2. The liquid discharge apparatus according to claim 1, wherein the adhesion part is configured to rotate to change the adhesion surface facing the detection surface of the detector.

3. The liquid discharge apparatus according to claim 2, wherein the adhesion part is configured to move to switch a position of the adhesion surface from a mist adhesion position facing the discharge target to a detection position facing the detection surface of the detector.

4. The liquid discharge apparatus according to claim 3, further comprising:

a cleaner configured to clean the adhesion surface of the adhesion part, wherein the adhesion part is configured to move to switch the position of the adhesion surface between the mist adhesion position, the detection position, and a cleaning position facing the cleaner.

5. The liquid discharge apparatus according to claim 4, wherein the cleaner cleans the adhesion surface of the adhesion part while the liquid discharge device discharges the liquid.

6. The liquid discharge apparatus according to claim 3, wherein the adhesion part is configured to rotate to switch the position of the adhesion surface while the liquid discharge device discharges the liquid.

7. The liquid discharge apparatus according to claim 4, wherein the cleaner cleans the adhesion surface of the adhesion part while the liquid discharge device is maintained.

8. The liquid discharge apparatus according to claim 2, wherein the adhesion surface of the adhesion part includes a plurality of adhesion surfaces.

9. The liquid discharge apparatus according to claim 8, wherein one of the plurality of adhesion surfaces is at a mist adhesion position facing the discharge target when another of the plurality of adhesion surfaces is at a detection position facing the detection surface of the detector.

10. The liquid discharge apparatus according to claim 9, further comprising:

a cleaner configured to clean the adhesion surface of the adhesion part, wherein the plurality of adhesion surfaces includes:

a first adhesion surface at the mist adhesion position;

a second adhesion surface at the detection position; and a third adhesion surface at a cleaning position facing the cleaner, and the adhesion part is configured to rotate to switch positions of the first adhesion surface, the second adhesion surface, and the third adhesion surface between the mist adhesion position, the detection position, and the cleaning position facing the cleaner.

11. The liquid discharge apparatus according to claim 8, wherein the adhesion part has a shape of a plate.

12. The liquid discharge apparatus according to claim 8, wherein the adhesion part has a polygonal cross section.

13. The liquid discharge apparatus according to claim 2, wherein the adhesion part is configured to rotate to change the adhesion surface facing the detection surface of the detector at every predetermined timing.

14. The liquid discharge apparatus according to claim 2, wherein the adhesion part is configured to rotate to change the adhesion surface facing the detection surface of the detector according to a number of liquid discharge from the liquid discharge device.

15. The liquid discharge apparatus according to claim 2, wherein the adhesion part has a shape of column.

16. The liquid discharge apparatus according to claim 15, further comprising:

a cleaner configured to clean the adhesion surface of the adhesion part, wherein the adhesion part is configured to rotate while the liquid discharge device discharges the liquid, and a cleaning operation of the cleaner cleaning the adhesion surface and a detection operation of the detector detecting the surface state of the adhesion surface are sequentially performed during a rotation of the adhesion part.

17. The liquid discharge apparatus according to claim 1, wherein the discharge surface of the liquid discharge device, the adhesion surface of the adhesion part, and the detection surface of the detector are arranged on a same side with respect to the discharge target.

18. The liquid discharge apparatus according to claim 1, wherein the adhesion part is on a downstream of the liquid discharge device in a conveyance direction of the discharge target.

19. A liquid discharge apparatus comprising:

a liquid discharge device configured to discharge a liquid onto a discharge target from nozzles on a discharge surface of the liquid discharge device in a liquid discharge direction;

an adhesion part rotatably movable and including an adhesion surface to which mist of the liquid discharged by the liquid discharge device adheres; and a detector including a detection surface facing the adhesion surface of the adhesion part, the detector configured to detect a surface state of the adhesion surface of the adhesion part, wherein the discharge surface of the liquid discharge device, the adhesion surface of the adhesion part, and the detection surface of the detector are arranged on a same side with respect to the discharge target.

* * * * *